US008659617B2

(12) United States Patent
Cho et al.

(10) Patent No.: US 8,659,617 B2
(45) Date of Patent: Feb. 25, 2014

(54) APPARATUS AND METHOD FOR DRIVING IMAGE DISPLAY APPARATUS

(75) Inventors: Seong-Ho Cho, Goyang-si (KR); Seong-Gyun Kim, Gunpo-si (KR); Su-Hyung Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 325 days.

(21) Appl. No.: 12/979,880

(22) Filed: Dec. 28, 2010

(65) Prior Publication Data

US 2011/0254884 A1 Oct. 20, 2011

(30) Foreign Application Priority Data

Apr. 16, 2010 (KR) ..... 10-2010-0035329

(51) Int. Cl.
*G09G 5/02* (2006.01)

(52) U.S. Cl.
CPC ..... *G09G 5/02* (2013.01)
USPC ..... 345/600

(58) Field of Classification Search
USPC ..... 345/691
See application file for complete search history.

(56) References Cited

U.S. PATENT DOCUMENTS 4,774,574 A * 9/1988 Daly et al. ..... 348/406.1
5,852,475 A * 12/1998 Gupta et al. ..... 348/606
5,920,356 A * 7/1999 Gupta et al. ..... 348/606
5,995,080 A 11/1999 Biro et al.
2004/0120597 A1* 6/2004 Le Dinh ..... 382/261
2004/0263443 A1* 12/2004 Shirasaki ..... 345/76
2005/0100241 A1* 5/2005 Kong et al. ..... 382/268
2005/0219158 A1* 10/2005 Shoji et al. ..... 345/63
2006/0233456 A1* 10/2006 Ahn et al. ..... 382/275
2008/0165206 A1* 7/2008 Wang ..... 345/611
2008/0192064 A1 8/2008 Hong et al.
2011/0148900 A1* 6/2011 Feng et al. ..... 345/589

FOREIGN PATENT DOCUMENTS

| | | |
|---|---|---|
| CN | 1985290 | 6/2007 |
| CN | 101221656 | 7/2008 |
| JP | 2000-075852 | 3/2000 |
| KR | 10-2006-0109805 | 10/2006 |

* cited by examiner

*Primary Examiner* — Dorothy Harris
(74) *Attorney, Agent, or Firm* — McKenna Long & Aldridge LLP

(57) ABSTRACT

An apparatus and method for driving an image display apparatus are disclosed. The apparatus includes a display panel having a plurality of pixels, for displaying an image, a panel driver for driving the pixels of the display panel, an image data converter for detecting a smooth region, an edge region, and a detail region from externally input image data in units of at least one frame and generating converted image data by changing a gray scale or chrominance of the image data at different rates in the smooth region, the edge region and the detail region, and a timing controller for arranging the converted image data suitably for driving of the display panel, providing the arranged image data to the panel driver, and controlling the panel driver by generating a panel control signal.

8 Claims, 7 Drawing Sheets

(a) (b)

APPARATUS AND METHOD FOR DRIVING IMAGE DISPLAY APPARATUS

This application claims the benefit of Korean Patent Application No. 10-2010-0035329, filed on Apr. 16, 2010, which is hereby incorporated by reference as if fully set forth herein.

BACKGROUND OF THE INVENTION

1. Field of the Invention

The present invention relates to an image display apparatus, and more particularly, to an apparatus and method for driving an image display apparatus, which detect a smooth region, an edge region, and a detail region from externally input image data and improve an image at different rates in the detected regions, thereby increasing the improvement efficiency of the image.

2. Discussion of the Related Art

Flat panel displays which have recently emerged include a Liquid Cristal Display (LCD), a field emission display, a plasma display panel, and a light emitting display.

Owing to their benefits of high resolution, superb color representation, and excellent image quality, the flat panel displays are widely used for laptop computers, desk top computers, and mobile terminals.

Conventionally, to enhance the clarity of an image displayed in such an image display apparatus, the clarity is changed uniformly across the image by filtering the data of the image. Specifically, the gray level or luminance of input image data is uniformly changed so that the difference in luminance or chroma between adjacent pixels gets large.

However, although the conventional method for uniformly changing image data through filtering may enhance the clarity of edge or detail regions of an image to be displayed, it increases noise in smooth regions of the image, thereby degrading the image quality of the smooth regions. As the image data is filtered strongly during conversion of the image data, that is, the image data is changed more greatly, noise also increases in the smooth regions perceived to the eyes of a user. As a consequence, the image quality of a displayed image is rather degraded.

SUMMARY OF THE INVENTION

Accordingly, the present invention is directed to an apparatus and method for driving an image display apparatus that substantially obviate one or more problems due to limitations and disadvantages of the related art.

An object of the present invention is to provide an apparatus and method for driving an image display apparatus, which increase the improvement efficiency of an image by detecting a smooth region, an edge region, and a detail region from externally input image data corresponding to the image and improving the image differently in the detected regions.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve this object and other advantages and in accordance with the purpose of the invention, as embodied and broadly described herein, an apparatus for driving an image display apparatus includes a display panel having a plurality of pixels, for displaying an image, a panel driver for driving the pixels of the display panel, an image data converter for detecting a smooth region, an edge region, and a detail region from externally input image data in units of at least one frame and generating converted image data by changing a gray scale or chrominance of the image data at different rates in the smooth region, the edge region and the detail region, and a timing controller for arranging the converted image data suitably for driving of the display panel, providing the arranged image data to the panel driver, and controlling the panel driver by generating a panel control signal.

The image data converter may include at least one of a first characteristic-based region detection unit for detecting smooth region information, edge region information, and detail region information using a mean luminance deviation of adjacent pixels in the image data and outputting the detected smooth region information, edge region information, and detail region information, in units of at least one frame, a second characteristic-based region detection unit for detecting smooth region information, edge region information, and detail region information using a mean chrominance deviation of the adjacent pixels in the image data and outputting the detected smooth region information, edge region information, and detail region information, in units of at least one frame, and a third characteristic-based region detection unit for detecting the number of edge pixels by filtering the image data in units of at least one frame and outputting smooth region information, edge region information, and detail region information according to the counted number of edge pixels, a detected region summation unit for respectively summing the smooth region information, the edge region information, and the detail region information received from at least one of the first, second and third characteristic-based region detection units in units of at least one frame, arranging the summed smooth region information, the summed edge region information, and the summed detail region information in units of at least one frame, and outputting a smooth region data sum, an edge region data sum, and a detail region data sum on a frame basis, and a data processor for generating the converted image data by changing the gray level or chrominance of the input image data at different rates for the smooth region data sum, the edge region data sum, and the detail region data sum.

The first characteristic-based region detection unit may include a first image mean deviation detector for calculating a mean luminance deviation of the adjacent pixels in the image data, comparing the mean luminance deviation with a first threshold set by a user, detecting smooth region data and edge region data according to a result of the comparison, and outputting the detected smooth region data and edge region data, a first smooth region information arranger for generating the smooth region information on a frame basis by arranging the smooth region data on a frame basis and outputting the smooth region information, a first Low Band Pass Filter (LBPF) for increasing a gray level difference or luminance difference between adjacent data in the detected edge region data, a first detail region detector for separating edge data and detail data from the difference-increased edge region data by comparing the difference-increased edge region data with a second threshold set by the user and outputting the edge data and the detail data, a first edge region information arranger for generating the edge region information on a frame basis by arranging the edge data on a frame basis and outputting the edge region information, and a first detail edge region information arranger for generating the detail region information on a frame basis by arranging the detail data on a frame basis and outputting the detail region information.

The second characteristic-based region detection unit may include a luminance/chrominance detector for detecting a luminance/chrominance component from the image data and outputting chrominance data, a second image mean deviation detector for calculating a mean chrominance deviation of the adjacent pixels in the image data, comparing the mean chrominance deviation with the first threshold set by the user, detecting smooth region data and edge region data according to a result of the comparison, and outputting the detected smooth region data and edge region data, a second smooth region information arranger for generating the smooth region information on a frame basis by arranging the smooth region data on a frame basis and outputting the smooth region information, a second LBPF for increasing a chrominance difference between adjacent data in the detected edge region data, a second detail region detector for separating edge data and detail data from the difference-increased edge region data by comparing the difference-increased edge region data with the second threshold set by the user and outputting the edge data and the detail data, a second edge region information arranger for generating the edge region information on a frame basis by arranging the edge data on a frame basis and outputting the edge region information, and a second detail edge region information arranger for generating the detail region information on a frame basis by arranging the detail data on a frame basis and outputting the detail region information.

The third characteristic-based region detection unit may include a sobel filter for increasing the gray level difference or luminance difference between the adjacent pixels in the image data by filtering the image data in units of at least one frame, a third detail region detector for detecting the number of edge pixels by filtering the image data in units of at least one frame, classifying edge data and detail data according to the counted number of edge pixels, and classifying the other data as smooth data, a third smooth region information arranger for generating the smooth region information on a frame basis by arranging the smooth data on a frame basis and outputting the smooth region information, a third edge region information arranger for generating the edge region information on a frame basis by arranging the edge data on a frame basis and outputting the edge region information, and a third detail edge region information arranger for generating the detail region information on a frame basis by arranging the detail data on a frame basis and outputting the detail region information.

In another aspect of the present invention, a method for driving an image display apparatus includes detecting a smooth region, an edge region, and a detail region from externally input image data in units of at least one frame and generating converted image data by changing a gray scale or chrominance of the image data at different rates in the smooth region, the edge region and the detail region, arranging the converted image data suitably for driving of an image display panel and providing the arranged image data to a panel driver for driving the image display panel, and controlling the panel driver by generating a panel control signal.

The generation of the converted image data may include performing at least one of a first operation for detecting smooth region information, edge region information, and detail region information using a mean luminance deviation of adjacent pixels in the image data and outputting the detected smooth region information, edge region information, and detail region information, in units of at least one frame, a second operation for detecting smooth region information, edge region information, and detail region information using a mean chrominance deviation of the adjacent pixels in the image data and outputting the detected smooth region information, edge region information, and detail region information, in units of at least one frame, and a third operation for detecting the number of edge pixels by filtering the image data in units of at least one frame and outputting smooth region information, edge region information, and detail region information according to the counted number of edge pixels, summing respectively the smooth region information, the edge region information, and the detail region information detected by performing the at least one of the first, second and third operations in units of at least one frame, arranging the summed smooth region information, the summed edge region information, and the summed detail region information in units of at least one frame, and outputting a smooth region data sum, an edge region data sum, and a detail region data sum on a frame basis, and generating the converted image data by changing the gray level or chrominance of the input image data at different rates for the smooth region data sum, the edge region data sum, and the detail region data sum.

The first operation may include calculating a mean luminance deviation of the adjacent pixels in the image data, comparing the mean luminance deviation with a first threshold set by a user, detecting smooth region data and edge region data according to a result of the comparison, outputting the detected smooth region data and edge region data, generating the smooth region information on a frame basis by arranging the smooth region data on a frame basis, outputting the smooth region information, increasing a gray level difference or luminance difference between adjacent data in the detected edge region data, separating edge data and detail data from the difference-increased edge region data by comparing the difference-increased edge region data with a second threshold set by the user, and outputting the edge data and the detail data, generating the edge region information on a frame basis by arranging the edge data on a frame basis and outputting the edge region information, and generating the detail region information on a frame basis by arranging the detail data on a frame basis and outputting the detail region information.

The second operation may include detecting a luminance/chrominance component from the image data and outputting chrominance data, calculating a mean chrominance deviation of the adjacent pixels in the image data, comparing the mean chrominance deviation with the first threshold set by the user, detecting smooth region data and edge region data according to a result of the comparison, and outputting the detected smooth region data and edge region data, generating the smooth region information on a frame basis by arranging the smooth region data on a frame basis and outputting the smooth region information, increasing a chrominance difference between adjacent data in the detected edge region data, separating edge data and detail data from the difference-increased edge region data by comparing the difference-increased edge region data with the second threshold set by the user and outputting the edge data and the detail data, generating the edge region information on a frame basis by arranging the edge data on a frame basis and outputting the edge region information, and generating the detail region information on a frame basis by arranging the detail data on a frame basis and outputting the detail region information.

The third operation may include increasing the gray level difference or luminance difference between the adjacent pixels in the image data by filtering the image data in units of at least one frame, detecting the number of edge pixels by filtering the image data in units of at least one frame, classifying edge data and detail data according to the counted number of edge pixels, and classifying the other data as smooth data, generating the smooth region information on a frame basis by arranging the smooth data on a frame basis and outputting the smooth region information, generating the edge region information on a frame basis by arranging the edge data on a frame basis and outputting the edge region information, and generating the detail region information on a frame basis by arranging the detail data on a frame basis and outputting the detail region information.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts. While an image display apparatus of the present invention may be any of a Liquid Crystal Display (LCD) device, a field emission display, a plasma display panel, and a light emitting display, the following description will be made in the context of an LCD device, for the convenience's sake of description.

Figure 1:
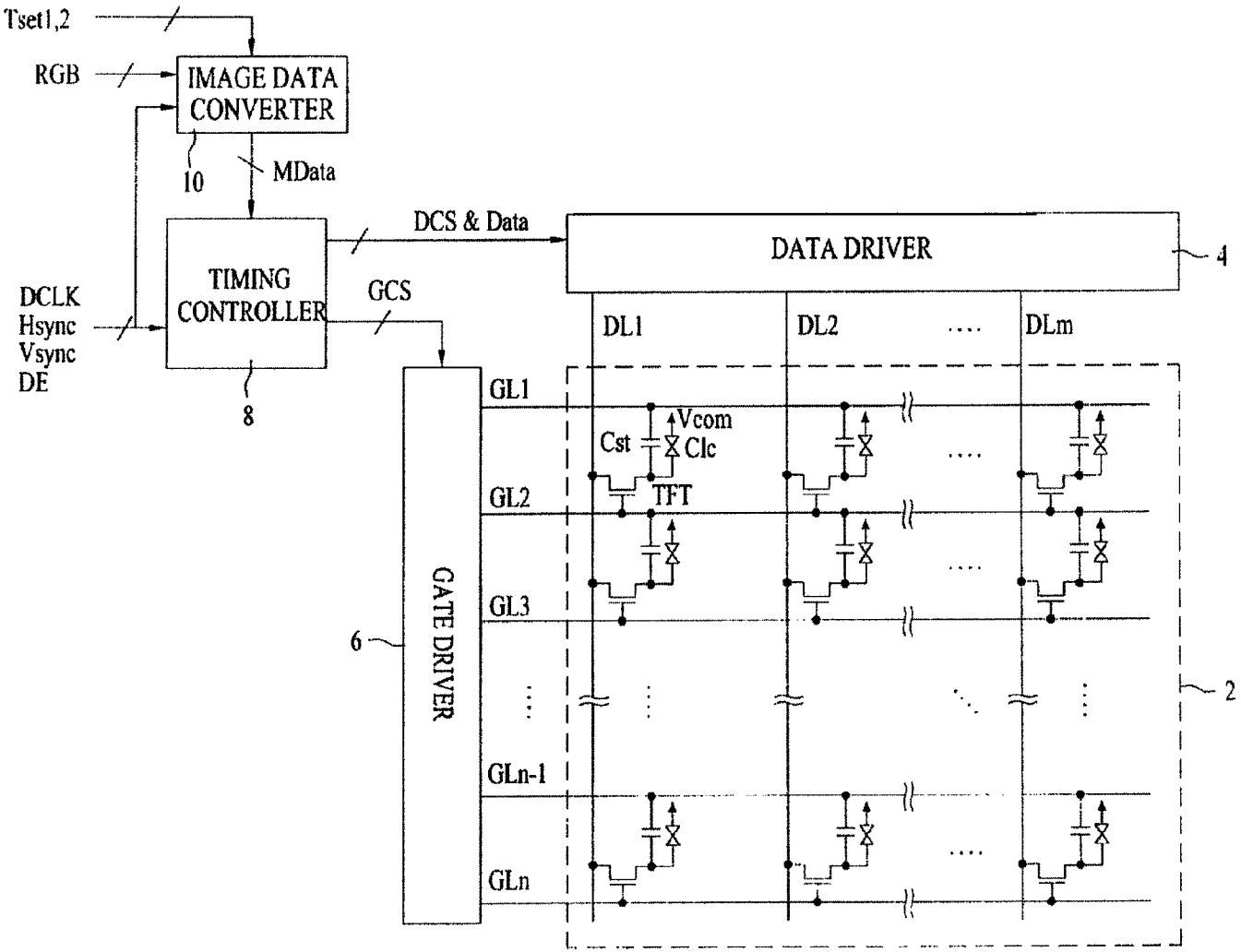
FIG. 1 illustrates the configuration of an apparatus for driving a Liquid Crystal Display (LCD) device according to an exemplary embodiment of the present invention.

FIG. 1 illustrates the configuration of an LCD device according to an exemplary embodiment of the present invention.

Referring to FIG. 1, the LCD device includes a liquid crystal panel 2 having a plurality of pixels, for displaying an image, a data driver 4 for driving a plurality of data lines DL1 to DLm provided in the liquid crystal panel 2, a gate driver 6 for driving a plurality of gate lines GL1 to GLn provided in the liquid crystal panel 2, an image data converter 10 for detecting a smooth region, an edge region and a detail region from externally input image data (i.e. Red, Green, Blue (RGB) data) in units of at least one frame, changing the gray level or chrominance of the image data in the detected regions at different rates, and thus producing converted image data MData, and a timing controller 8 for arranging the converted image data MData suitably for driving of the liquid crystal panel 2 and providing the arranged image data to the data driver 4, while controlling the gate driver 6 and the data driver 4 by generating a gate control signal GCS and a data control signal DCS.

The liquid crystal panel 2 is provided with a Thin Film Transistor (TFT) formed at each of pixel regions defined by the plurality of gate lines GL1 to GLn and the plurality of data lines DL1 to DLm, and liquid crystal capacitors Clc connected to the TFTs. Each liquid crystal capacitor Clc includes a pixel electrode connected to a TFT and a common electrode facing the pixel electrode with a liquid crystal in between. The TFT provides an image signal received from a data line to the pixel electrode in response to a scan pulse from a gate line. The liquid crystal capacitor Clc is charged with the difference voltage between the image signal provided to the pixel electrode and a common voltage supplied to the common electrode and changes the orientation of liquid crystal molecules according to the difference voltage, thereby controlling light transmittance and thus realizing a gray level. A storage capacitor Cst is connected to the liquid crystal capacitor Clc in parallel, for keeping the voltage charged in the liquid crystal capacitor Clc until the next data signal is provided. The storage capacitor Cst is formed by depositing an insulation layer between the pixel electrode and the previous gate line. Alternatively, the storage capacitor Cst may be formed by depositing an insulation layer between the pixel electrode and a storage line.

The data driver 4 converts image data arranged by the timing controller 8 to analog voltages, that is, image signals using the data control signal DCS received from the timing controller 8, for instance, a source start pulse SSP, a source shift clock signal SSC, and a source output enable signal SOE. Specifically, the data driver 4 latches image data which have been converted to gamma voltages and arranged by the timing controller 8 in response to the SSC, provides image signals for one horizontal line to the data lines DL1 to DLm in every horizontal period during which scan pulses are provided to the gate lines GL1 to GLn. Herein, the data driver 4 selects positive or negative gamma voltages having predetermined levels according to the gray levels of the arranged image data and supplies the selected gamma voltages as image signals to the data lines DL1 to DLm.

The gate driver 6 sequentially generates scan pulses in response to the gate control signal GCS received from the timing controller 8, for example, a gate start pulse GSP, a gate shift clock signal GSC, and a gate output enable signal GOE, and sequentially supplies the scan pulses to the gate lines GL1 to GLn. Specifically, the gate driver 6 supplies scan pulses, for example, gate-on voltages sequentially to the gate lines G11 to GLn by shifting the gate start pulse GSP received from the timing controller 8 according to the gate shift clock GSC signal. During a period in which gate-on voltages are not supplied to the gate lines GL1 to GLn, the gate driver 6 supplies gate-off voltages to the gate lines GL1 to GLn. The gate driver 6 controls the width of a scan pulse according to the GOE signal.

The image data converter 10 detects smooth region information, edge region information, and detail region information from RGB data received from an external device such as a graphic system (not shown) in units of at least one frame and changes the gray level or chrominance of the RGB data based on the smooth region information, the edge region information, the detail region information, and at least one threshold preset by a user, Tset 1 or Tset 2, thus creating the converted image data MData. To be more specific, the image data converter 10 generates the converted image data MData by changing the gray level or chrominance of the RGB data in smooth, edge and detail regions at different rates. The image data converter 10 of the present invention will be described later in great detail.

The timing controller 8 arranges the converted image data MData received from the image data converter 10 suitably for driving of the liquid crystal panel 2 and provides the arranged image data to the data driver 4. Also, the timing controller 8 generates the gate control signal GCS and the data control signal DCS using at least one of externally received synchronization signals, that is, a dot clock signal DCLK, a data enable signal DE, and horizontal and vertical synchronization signals Hsync and Vsync and provides the gate control signal GCS and the data control signal DCS to the gate driver 6 and the data driver 4, thereby controlling the gate driver 6 and the data driver 4, respectively.

Figure 2:
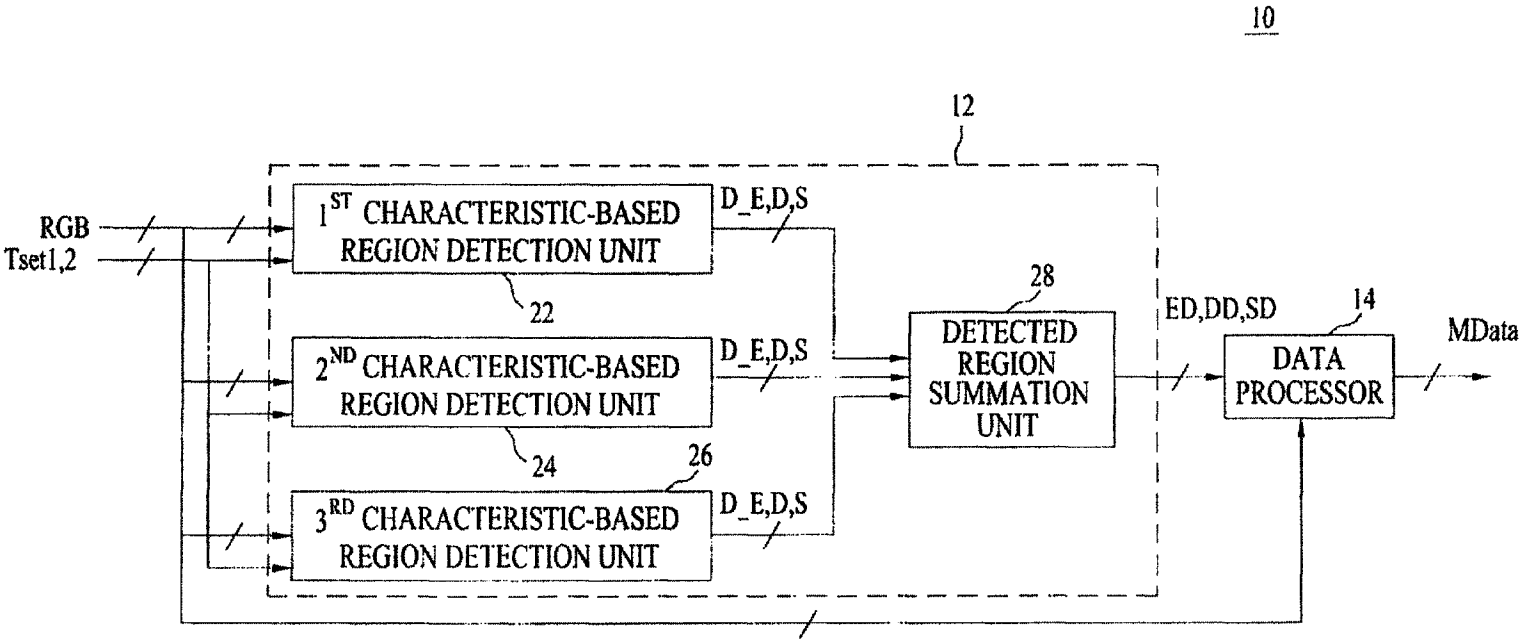
FIG. 2 is a block diagram of an image data converter illustrated in FIG. 1.

FIG. 2 is a block diagram of the image data converter illustrated in FIG. 1.

Referring to FIG. 2, the image data converter 10 includes at least one of a first characteristic-based region detection unit 22 for detecting smooth region information D_S, edge region information D_E, and detail region information D_D in units of at least one frame using the mean luminance deviation of adjacent pixels in RGB data, a second characteristic-based region detection unit 24 for detecting smooth region information D_S, edge region information D_E, and detail region information D_D in units of at least one frame using the mean chrominance deviation of the adjacent pixels in the RGB data, and a third characteristic-based region detection unit 26 for determining the number of edge pixels by filtering the RGB data in units of at least one frame and outputting smooth region information D_S, edge region information D_E, and detail region information D_D according to the number of edge pixels. The image data converter further includes a detected region summation unit 28 for respectively summing and arranging the smooth region information D_S, the edge region information D_E, and the detail region information D_D received from the at least one of the first, second and third characteristic-based region detection units 22, 24 and 26 in units of at least one frame, and outputting the sums of smooth region data, edge region data, and detail region data, SD, ED and DD on a frame basis, and a data processor 14 for generating the converted image data MData by changing the gray level or chrominance of the input RGB data at different rates for the sums of the smooth region data, the edge region data, and the detail region data of a frame, SD, ED and DD.

The first, second and third characteristic-based region detection units 22, 24 and 26 are used to separate an image into a smooth region, an edge region and a detail region in units of at least one frame such that the RGB data of an image to be displayed may be changed in gray level or chrominance at different rates in the smooth, edge and detail regions. While the image data converter may be provided with at least one of the first, second and third characteristic-based region detection units 22, 24 and 26, the following description is made with the appreciation that the image data converter includes all of the first, second and third characteristic-based region detection units 22, 24 and 26.

The data processor 14 filters the RGB data to different degrees according to the sums of the smooth region data, the edge region data, and the detail region data, SD, ED and DD. To be more specific, the data processor 14 may apply different filtering degrees to the smooth, edge and detail regions or may use a Low Band Pass Filter (LBPF) only to one of the smooth, edge and detail regions, for example, only to the detail region. In this manner, the data processor 14 is programmed to generate the converted image data MData by changing the gray level or chrominance of the input RGB data at different rates in the respective detected regions.

Figure 3:
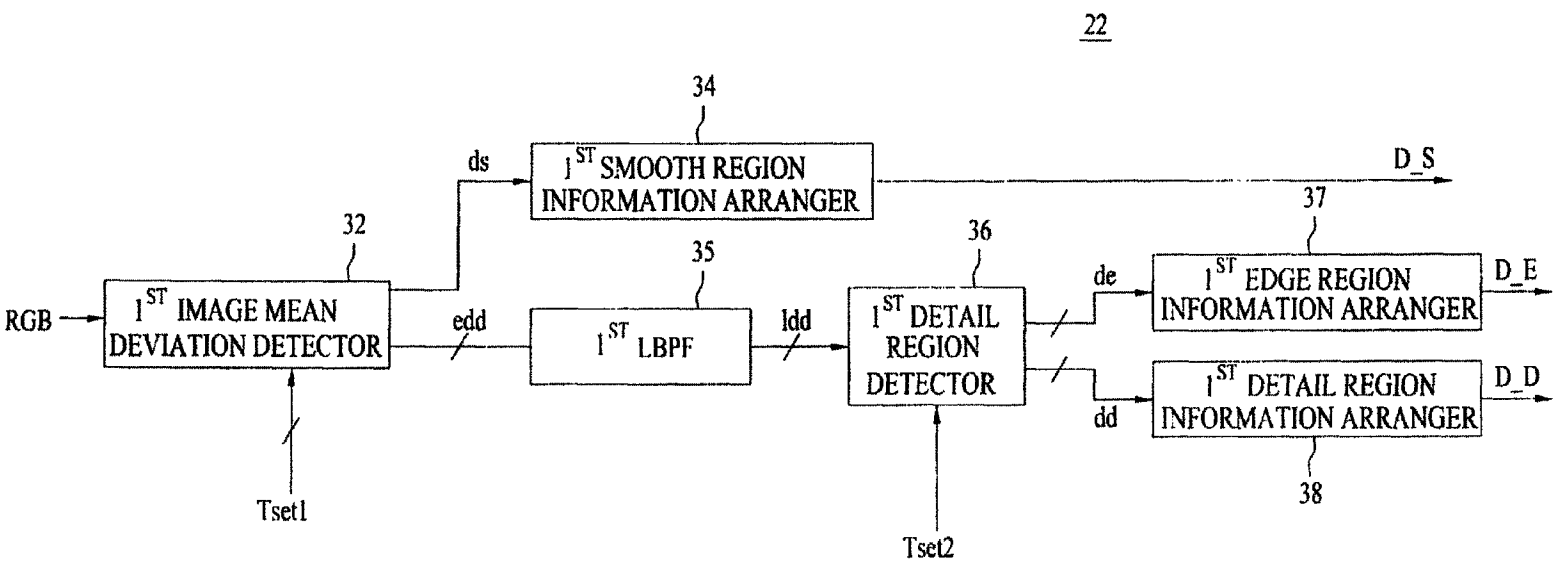
FIG. 3 is a block diagram of a first characteristic-based region detection unit illustrated in FIG. 2.

FIG. 3 is a block diagram of the first characteristic-based region detection unit illustrated in FIG. 2.

Referring to FIG. 3, the first characteristic-based region detection unit 22 includes a first image mean deviation detector 32 for detecting the mean luminance deviation of adjacent pixels in the RGB data, comparing the mean luminance deviation with the first threshold Tset1 set by the user, and detecting smooth region data ds and edge region data edd according to the comparison result, a first smooth region information arranger 34 for generating the smooth region information D_S by arranging the smooth region data ds on a frame basis, a first LBPF 35 for increasing the gray level difference or luminance difference between adjacent data in the detected edge region data edd and thus outputting the resulting edge region data ldd, a first detail region detector 36 for separating edge data de and detail data dd from the edge region data ldd, a first edge region information arranger 37 for generating the edge region information D_E on a frame basis by arranging the edge data de on a frame basis, and a first detail region information arranger 38 for generating the detail region information D_D on a frame basis by arranging the detail data dd on a frame basis.

The first image mean deviation detector 32 determines and detects edge regions of the image to be displayed based on the luminance of each pixel of the RGB data. If a large edge region is detected, the edge region may be classified as an edge region. On the other hand, if small edge regions are distributed consecutively, they may be classified as detail regions. In order to identify a smooth region and an edge or detail region, the first image mean deviation detector 32 calculates the mean luminance of adjacent pixels and the mean of the luminance deviations of the adjacent pixels from the mean luminance, that is, the mean luminance deviation of the adjacent pixels and detects the smooth region data ds and the edge region data edd by comparing the mean luminance deviation of the adjacent pixels with the first threshold Tset1 set by the user. The mean luminance of the adjacent pixels, mean(n) may be calculated by $$\text{mean}(n) = \frac{\sum_{i=(N-1)/2}^{(N-1)/2} Y(n-i)}{N} \quad \text{[Equation 1]}$$

where N denotes the size of a filtering window tap for filtering to identify edges and Y(n) denotes the luminance values of the pixels within the filtering window tap.

Then the mean luminance deviation of the adjacent pixels, mean_dev(n) may be determined using the mean luminance mean(n) by $$\text{mean_dev}(n) = \frac{\sum_{i=-(N-1)/2}^{(N-1)/2} |Y(n-i) - \text{mean}(n)|}{N} \quad \text{[Equation 2]}$$

After calculating the mean luminance deviation of the adjacent pixels mean_dev(n), the first image mean deviation detector 32 compares the mean luminance deviation mean_dev(n) with the first threshold Tset1 and detects the smooth region data ds and the edge region data edd according to the comparison result.

Figure 4:
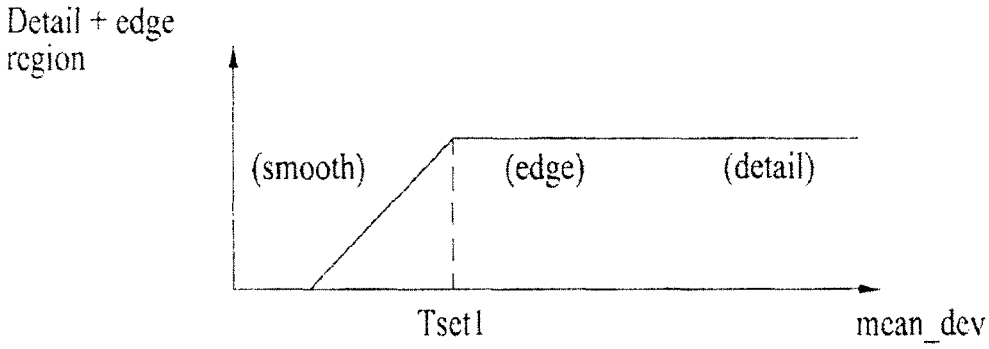
FIG. 4 is a graph illustrating separation between smooth region data and edge region data.

As illustrated in FIG. 4, the first threshold Tset1 is set so that the smooth region data ds experiencing much noise may be distinguished from the edge region data edd. Therefore, if the sequentially calculated mean luminance deviation of adjacent pixels, mean_dev(n) is less than the first threshold Tset1, the first image mean deviation detector 32 determines that the pixels are included in a smooth region and outputs the smooth region data ds.

If the mean luminance deviation of adjacent pixels, mean_dev(n) is equal to or larger than the first threshold Tset1, the first image mean deviation detector 32 determines that the pixels are included in an edge or detail region and outputs the edge region data edd.

The first smooth region information arranger 34 arranges the smooth region data ds received from the first image mean deviation detector 32 on a frame basis, and generates the smooth region information D_S according to in-frame arrangement information about the smooth region data ds. To be more specific, the first smooth region information arranger 34 arranges the smooth region data ds on a frame basis and outputs the smooth region information D_S based on information about the locations of the smooth region data ds.

The first LBPF 35 receives the edge region data edd from the first image mean deviation detector 32 and low-pass-filters the edge region data edd so as to increase the difference in gray level or luminance between adjacent data in the edge region data edd. The low-pass filtering may be performed to more accurately distinguish the edge data de from the detail data dd by increasing the gray level difference or luminance difference between adjacent data.

Figure 5:
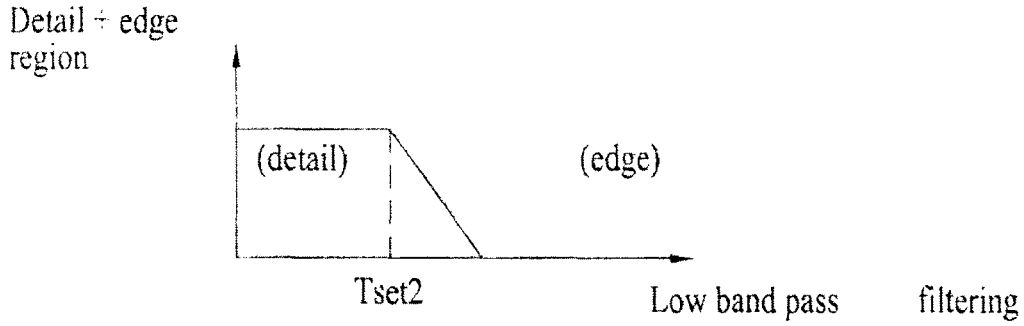
FIG. 5 is a graph illustrating separation between edge region data and detail region data.

The first detail region detector 36 compares the second threshold Tset2 with the edge region data ldd with the gray level difference or luminance difference increased between the adjacent data and thus separates the edge region data ldd into the edge data de and the detail data dd. As illustrated in FIG. 5, the second threshold Tset2 is set such that loosely populated edge regions may be classified as edge regions and densely populated edge regions may be classified as detail regions. Therefore, if the sequentially obtained edge region data edd is less than the second threshold Tset2, the first detail region detector 36 determines that pixels corresponding to the edge region data edd are included in a detail region and thus outputs the detail data dd. On the other hand, if the edge region data edd is equal to or larger than the second threshold Tset2, the first detail region detector 36 determines that the pixels corresponding to the edge region data edd are included in an edge region and thus outputs the edge data de.

The first edge region information arranger 37 arranges the edge data de received from the first detail region detector 36 on a frame basis and generates the edge region information D_E according to in-frame arrangement information about the edge data de. That is, the first edge region information arranger 37 arranges the edge data de on a frame basis and outputs the edge region information D_E based on information about the locations of the arranged edge data de.

Similarly, the first detail region information arranger 38 arranges the detail data dd received from the first detail region detector 36 on a frame basis and generates the detail region information D_D based on in-frame arrangement information about the detail data dd.

Figure 6:
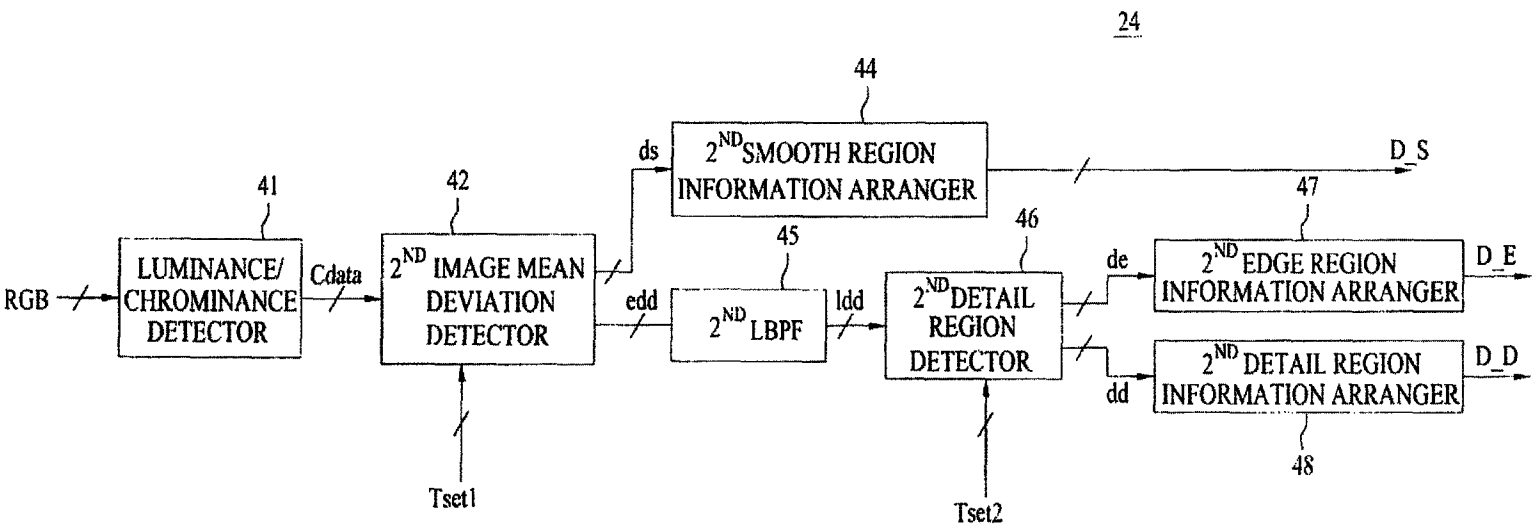
FIG. 6 is a block diagram of a second characteristic-based region detection unit illustrated in FIG. 2.

FIG. 6 is a block diagram of the second characteristic-based region detection unit illustrated in FIG. 2.

Referring to FIG. 2, the second characteristic-based region detection unit 24 includes a luminance/chrominance detector 41 for detecting a luminance/chrominance component and thus outputting chrominance data Cddata, a second image mean deviation detector 42 for calculating the mean chrominance deviation of adjacent pixels using the chrominance data Cddata, comparing the mean chrominance deviation with the first threshold Tset1, and detecting smooth region data ds and edge region data edd, a second smooth region information arranger 44 for generating the smooth region information D_S by arranging the smooth region data ds on a frame basis, a second LBPF 45 for increasing the chrominance difference between the adjacent data in the detected edge region data edd, a second detail region detector 46 for separating edge region data ldd with the chrominance difference increased between the adjacent data into edge data de and detail data dd by comparing the edge region data ldd with the second threshold Tset2, a second edge region information arranger 47 for generating the edge region information D_E by arranging the edge data de on a frame basis, and a second detail region information arranger 48 for generating the detail region information D_D by arranging the detail data dd on a frame basis.

The luminance/chrominance detector 41 separates a luminance component Y and chrominance components U and V from the externally input RGB data by [Equation 3], [Equation 4] and [Equation 5] and provides the chrominance data Cddata to the second image mean deviation detector 42.

$$Y=0.229\times R+0.587\times G+0.114\times B \quad \text{[Equation 3]}$$

$$U=0.493\times(B-Y) \quad \text{[Equation 4]}$$

$$V=0.887\times(R-Y) \quad \text{[Equation 5]}$$

The second image mean deviation detector 42 determines and detects edge regions of the image to be displayed based on the chrominance data Cddata of each pixel of the RGB data. If small edge regions are distributed consecutively, the edge regions may be classified as detail regions. In order to identify a smooth region and an edge or detail region, the second image mean deviation detector 42 calculates the mean chrominance of adjacent pixels and the mean of chrominance deviations of the adjacent pixels from the mean chrominance, that is, the mean chrominance deviation of the adjacent pixels and detects the smooth region data ds and the edge region data edd by comparing the mean chrominance deviation of the adjacent pixels with the first threshold Tset1 set by the user. The mean chrominance of the adjacent pixels, mean(n) may be calculated by $$\text{mean}(n)=\frac{\sum_{i=(N-1)/2}^{(N-1)/2} Cb(n-i)}{N} \quad \text{[Equation 6]}$$

where N denotes the size of a filtering window tap for filtering to identify edges and Cb denotes the chrominance values of the pixels within the filtering window tap.

Then the mean chrominance deviation of the adjacent pixels, mean_dev(n) may be determined using the mean chrominance mean(n) by $$\text{mean_dev}(n)=\frac{\sum_{i=-(N-1)/2}^{(N-1)/2} |Cb(n-i)-\text{mean}(n)|}{N} \quad \text{[Equation 7]}$$

After calculating the mean chrominance deviation of the adjacent pixels mean_dev(n), the second image mean deviation detector 42 compares the mean chrominance deviation mean_dev(n) with the first threshold Tset1 and detects the smooth region data ds and the edge region data edd according to the comparison result. As illustrated in FIG. 4, the first threshold Tset1 is set so that the smooth region data ds experiencing much noise may be distinguished from the edge region data edd.

The second smooth region information arranger 44 arranges the smooth region data ds received from the second image mean deviation detector 42 on a frame basis, and generates the smooth region information D_S according to in-frame arrangement information about the smooth region data ds.

The second LBPF 45 receives the edge region data edd from the second image mean deviation detector 42 and low-pass-filters the edge region data edd so as to increase the chrominance difference between adjacent data in the edge region data edd. The low-pass filtering may be performed to more accurately distinguish the edge data de from the detail data dd by increasing the chrominance difference between adjacent data.

The second detail region detector 46 compares the second threshold Tset2 with the edge region data ldd with the chrominance difference increased between the adjacent data and thus separates the edge region data ldd into the edge data de and the detail data dd. As illustrated in FIG. 5, the second threshold Tset2 is set such that loosely populated edge regions may be classified as edge regions and densely populated edge regions may be classified as detail regions.

The second edge region information arranger 47 arranges the edge data de received from the second detail region detector 46 on a frame basis and generates the edge region information D_E according to in-frame arrangement information about the edge data de.

Similarly, the second detail region information arranger 48 arranges the detail data dd received from the second detail region detector 46 on a frame basis and generates the detail region information D_D based on in-frame arrangement information about the detail data dd.

Figure 7:
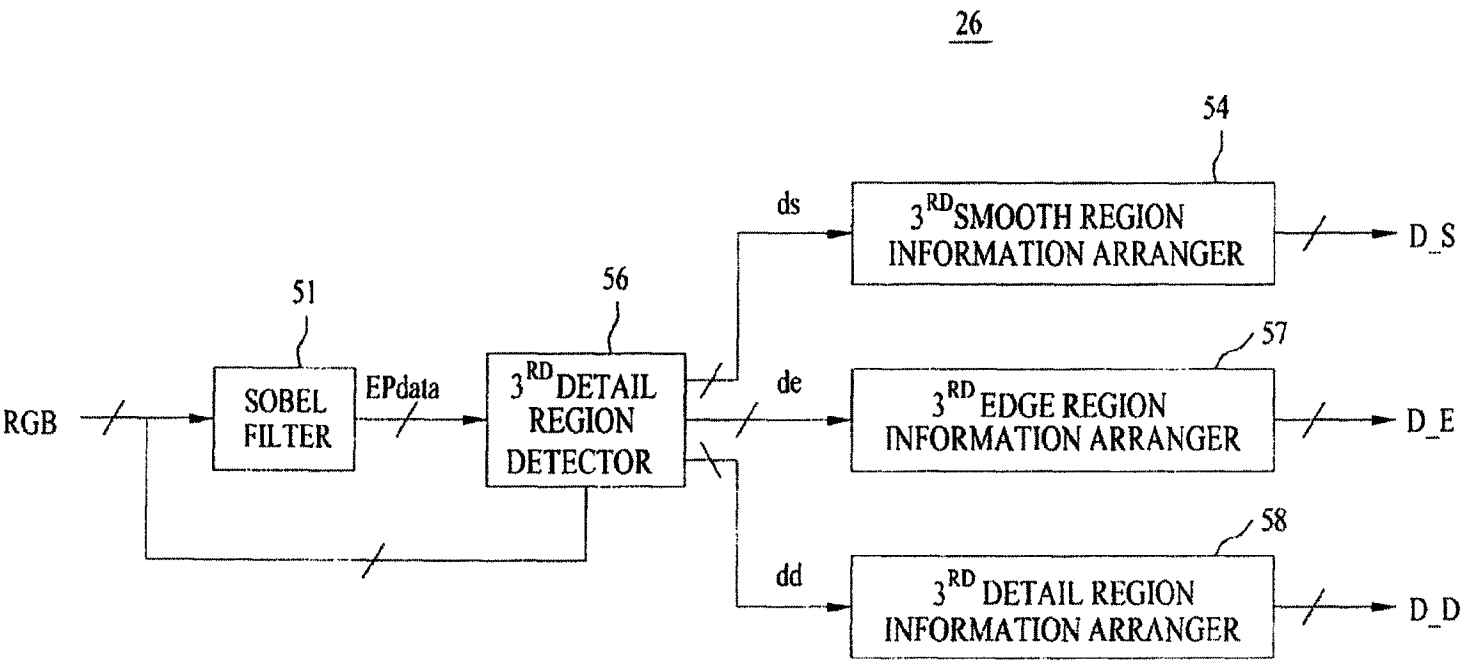
FIG. 7 is a block diagram of a third characteristic-based region detection unit illustrated in FIG. 2.

FIG. 7 is a block diagram of the third characteristic-based region detection unit illustrated in FIG. 2.

Referring to FIG. 7, the third characteristic-based region detection unit 26 includes a sobel filter 51 for increasing the gray level difference or luminance difference between adjacent data by filtering the RGB data in units of at least one frame and thus outputting the resulting data EPdata, a third detail region detector 56 for detecting edge pixels from the filtered data EPdata, counting the number of the detected edge pixels, classifying edge data de and detail data dd according to the number of the edge pixels, and classifying the other data as smooth data ds, a third smooth region information arranger 54 for generating the smooth region information D_S on a frame basis by arranging the smooth data ds on a frame basis, a third edge region information arranger 57 for generating the edge region information D_E on a frame basis by arranging the edge data de on a frame basis, and a third detail region information arranger 58 for generating the detail region information D_D on a frame basis by arranging the detail data dd on a frame basis.

The sobel filter 51 increases the gray level difference between adjacent data by filtering the RGB data in units of at least one frame by sobel filter programming.

The third detail region detector 56 detects edge pixels from the filtered data EPdata with the gray level difference increased between the adjacent data, counts the number of the edge pixels, and classifies the edge data de and the detail data dd according to the number of the edge pixels, while classifying the other data as the smooth data ds.

Figure 8:
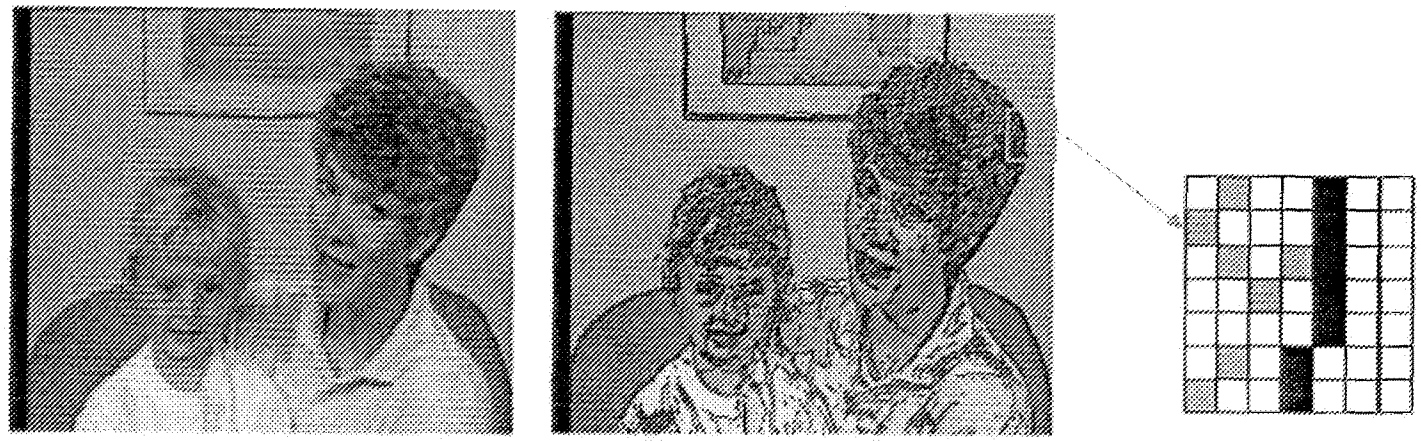
FIG. 8 illustrates an operation for detecting edge pixels in the third characteristic-based region detection unit illustrated in FIG. 7.

FIG. 8 illustrates an operation for detecting edge pixels in the third detail region detector illustrated in FIG. 7.

FIG. 8(*a*) illustrates an original image before sobel filtering, and FIG. 8(*b*) illustrates a method for detecting edge pixels from the original image. The third detail region detector 56 detects edge pixels from filtered data EPdata and counts the number of the edge pixels, as illustrated in FIG. 8(*b*). Then the third detail region detector 56 classifies edge data de and detail data dd according to the number of the edge pixels, while classifying the other data as smooth data ds.

The third smooth region information arranger 54 arranges the smooth data ds on a frame basis and generates the smooth region information D_S based on in-frame arrangement information about the smooth data ds.

The third edge region information arranger 57 arranges the edge data de received from the third detail region detector 56 on a frame basis and generates the edge region information D_E based on in-frame arrangement information about the edge data de.

Similarly, the third detail region information arranger 58 arranges the detail data dd received from the third detail region detector 56 on a frame basis and generates the detail region information D_D based on in-frame arrangement information about the detail data dd.

The detected region summation unit 28 illustrated in FIG. 2 receives the smooth region information D_S, the edge region information D_E, and the detail region information D_D from at least one of the first, second and third characteristic-based region detection units 22, 24 and 26 through the above-described operation, rearranges each of the smooth region information D_S, the edge region information D_E, and the detail region information D_D on a frame basis, and thus generates the sums of smooth region data, edge region data, and detail region data, SD, ED and DD.

The data processor 14 generates the converted image data MData by changing the luminance or gray level of the input RGB data at different rates for the sums of smooth region data, edge region data, and detail region data, SD, ED and DD.

As is apparent from the above description, the apparatus and method for driving an image display apparatus according to exemplary embodiments of the present invention detect a smooth region, an edge region and a detail region from input image data and improve the image at different rates for the smooth region, the edge region and the detail region. Therefore, the clarity of a displayed image is improved according to the characteristics of the displayed image, thereby increasing the clarity improvement efficiency of the image.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for driving an image display apparatus, comprising:

a display panel having a plurality of pixels, for displaying an image;

a panel driver for driving the pixels of the display panel;

an image data converter for detecting a smooth region, an edge region, and a detail region from externally input image data in units of at least one frame and generating converted image data by changing a gray scale or chrominance of the image data at different rates in the smooth region, the edge region and the detail region, wherein the image data converter comprises:

a first characteristic-based region detection unit for detecting smooth region information, edge region information, and detail region information using a mean luminance deviation of adjacent pixels in the image data and outputting the detected smooth region information, edge region information, and detail region information, in units of at least one frame, a second characteristic-based region detection unit for detecting smooth region information, edge region information, and detail region information using a mean chrominance deviation of the adjacent pixels in the image data and outputting the detected smooth region information, edge region information, and detail region information, in units of at least one frame, and a third characteristic-based region detection unit for detecting the number of edge pixels by filtering the image data in units of at least one frame and outputting smooth region information, edge region information, and detail region information according to the counted number of edge pixels;

a detected region summation unit for respectively summing the smooth region information, the edge region information, and the detail region information received from each of the first, second and third characteristic-based region detection units in units of at least one frame, arranging the summed smooth region information, the summed edge region information, and the summed detail region information in units of at least one frame, and outputting a smooth region data sum, an edge region data sum, and a detail region data sum on a frame basis; and a data processor for generating the converted image data by changing the gray level or chrominance of the input image data at different rates in the respective the smooth regions, edge regions and detail regions for the smooth region data sum, the edge region data sum, and the detail region data sum; and a timing controller for arranging the converted image data suitably for driving of the display panel, providing the arranged image data to the panel driver, and controlling the panel driver by generating a panel control signal, wherein the image data converter is programmed to generate the converted image data by changing the gray level or chrominance of the input image data at different rates in the respective the smooth regions, edge regions and detail regions.

2. The apparatus according to claim 1, wherein the first characteristic-based region detection unit comprises:

a first image mean deviation detector for calculating a mean luminance deviation of the adjacent pixels in the image data, comparing the mean luminance deviation with a first threshold set by a user, detecting smooth region data and edge region data according to a result of the comparison, and outputting the detected smooth region data and edge region data;

a first smooth region information arranger for generating the smooth region information on a frame basis by arranging the smooth region data on a frame basis and outputting the smooth region information;

a first Low Band Pass Filter (LBPF) for increasing a gray level difference or luminance difference between adjacent data in the detected edge region data;

a first detail region detector for separating edge data and detail data from the difference-increased edge region data by comparing the difference-increased edge region data with a second threshold set by the user and outputting the edge data and the detail data;

a first edge region information arranger for generating the edge region information on a frame basis by arranging the edge data on a frame basis and outputting the edge region information; and a first detail region information arranger for generating the detail region information on a frame basis by arranging the detail data on a frame basis and outputting the detail region information.

3. The apparatus according to claim 1, wherein the second characteristic-based region detection unit comprises:

a luminance/chrominance detector for detecting a luminance/chrominance component from the image data and outputting chrominance data;

a second image mean deviation detector for calculating a mean chrominance deviation of the adjacent pixels in the image data, comparing the mean chrominance deviation with the first threshold set by the user, detecting smooth region data and edge region data according to a result of the comparison, and outputting the detected smooth region data and edge region data;

a second smooth region information arranger for generating the smooth region information on a frame basis by arranging the smooth region data on a frame basis and outputting the smooth region information;

a second LBPF for increasing a chrominance difference between adjacent data in the detected edge region data;

a second detail region detector for separating edge data and detail data from the difference-increased edge region data by comparing the difference-increased edge region data with the second threshold set by the user and outputting the edge data and the detail data;

a second edge region information arranger for generating the edge region information on a frame basis by arranging the edge data on a frame basis and outputting the edge region information; and a second detail region information arranger for generating the detail region information on a frame basis by arranging the detail data on a frame basis and outputting the detail region information.

4. The apparatus according to claim 1, wherein the third characteristic-based region detection unit comprises:

a sobel filter for increasing the gray level difference or luminance difference between the adjacent pixels in the image data by filtering the image data in units of at least one frame;

a third detail region detector for detecting the number of edge pixels by filtering the image data in units of at least one frame, classifying edge data and detail data according to the counted number of edge pixels, and classifying the other data as smooth data;

a third smooth region information arranger for generating the smooth region information on a frame basis by arranging the smooth data on a frame basis and outputting the smooth region information;

a third edge region information arranger for generating the edge region information on a frame basis by arranging the edge data on a frame basis and outputting the edge region information; and a third detail edge region information arranger for generating the detail region information on a frame basis by arranging the detail data on a frame basis and outputting the detail region information.

5. A method for driving an image display apparatus, comprising:

detecting a smooth region, an edge region, and a detail region from externally input image data in units of at least one frame and generating converted image data by changing a gray scale or chrominance of the image data at different rates in the smooth region, the edge region and the detail region, wherein the converted image data generation comprises:

performing a first operation for detecting smooth region information, edge region information, and detail region information using a mean luminance deviation of adjacent pixels in the image data and outputting the detected smooth region information, edge region information, and detail region information, in units of at least one frame, a second operation for detecting smooth region information, edge region information, and detail region information using a mean chrominance deviation of the adjacent pixels in the image data and outputting the detected smooth region information, edge region information, and detail region information, in units of at least one frame, and a third operation for detecting the number of edge pixels by filtering the image data in units of at least one frame and outputting smooth region information, edge region information, and detail region information according to the counted number of edge pixels;

summing respectively the smooth region information, the edge region information, and the detail region information detected by performing each of the first, second and third operations in units of at least one frame, arranging the summed smooth region information, the summed edge region information, and the summed detail region information in units of at least one frame, and outputting a smooth region data sum, an edge region data sum, and a detail region data sum on a frame basis; and generating the converted image data by changing the gray level or chrominance of the input image data at different rates in the respective the smooth regions, edge regions and detail regions for the smooth region data sum, the edge region data sum, and the detail region data sum;

arranging the converted image data suitably for driving of an image display panel and providing the arranged image data to a panel driver for driving the image display panel; and controlling the panel driver by generating a panel control signal, wherein the generating converted image data is programmed to generate the converted image data by changing the gray level or chrominance of the input image data at different rates in the respective the smooth regions, edge regions and detail regions.

6. The method according to claim 5, wherein the first operation comprises:

calculating a mean luminance deviation of the adjacent pixels in the image data, comparing the mean luminance deviation with a first threshold set by a user, detecting smooth region data and edge region data according to a result of the comparison, and outputting the detected smooth region data and edge region data;

generating the smooth region information on a frame basis by arranging the smooth region data on a frame basis and outputting the smooth region information;

increasing a gray level difference or luminance difference between adjacent data in the detected edge region data;

separating edge data and detail data from the difference-increased edge region data by comparing the difference-increased edge region data with a second threshold set by the user and outputting the edge data and the detail data;

generating the edge region information on a frame basis by arranging the edge data on a frame basis and outputting the edge region information; and generating the detail region information on a frame basis by arranging the detail data on a frame basis and outputting the detail region information.

7. The method according to claim 5, wherein the second operation comprises:

detecting a luminance/chrominance component from the image data and outputting chrominance data;

calculating a mean chrominance deviation of the adjacent pixels in the image data, comparing the mean chrominance deviation with the first threshold set by the user, detecting smooth region data and edge region data according to a result of the comparison, and outputting the detected smooth region data and edge region data;

generating the smooth region information on a frame basis by arranging the smooth region data on a frame basis and outputting the smooth region information;

increasing a chrominance difference between adjacent data in the detected edge region data;

separating edge data and detail data from the difference-increased edge region data by comparing the difference-increased edge region data with the second threshold set by the user and outputting the edge data and the detail data;

generating the edge region information on a frame basis by arranging the edge data on a frame basis and outputting the edge region information; and generating the detail region information on a frame basis by arranging the detail data on a frame basis and outputting the detail region information.

8. The method according to claim 5, wherein the third operation comprises:

increasing the gray level difference or luminance difference between the adjacent pixels in the image data by filtering the image data in units of at least one frame;

detecting the number of edge pixels by filtering the image data in units of at least one frame, classifying edge data and detail data according to the counted number of edge pixels, and classifying the other data as smooth data;

generating the smooth region information on a frame basis by arranging the smooth data on a frame basis and outputting the smooth region information;

generating the edge region information on a frame basis by arranging the edge data on a frame basis and outputting the edge region information; and generating the detail region information on a frame basis by arranging the detail data on a frame basis and outputting the detail region information.

* * * * *